US007163356B2

(12) United States Patent
Huang et al.

(10) Patent No.: US 7,163,356 B2
(45) Date of Patent: Jan. 16, 2007

(54) STEPPED TENDON WITH SEALED BULKHEADS FOR OFFSHORE PLATFORM

(75) Inventors: Edward Huang, Houston, TX (US); Shihwei Liao, Houston, TX (US)

(73) Assignee: Deepwater Marine Technology L.L.C., George Town (KY)

( * ) Notice: Subject to any disclaimer, the term of this patent is extended or adjusted under 35 U.S.C. 154(b) by 0 days.

(21) Appl. No.: 11/104,826

(22) Filed: Apr. 13, 2005

(65) Prior Publication Data

US 2005/0238439 A1 Oct. 27, 2005

Related U.S. Application Data

(60) Provisional application No. 60/561,831, filed on Apr. 13, 2004.

(51) Int. Cl.
*B63B 21/00* (2006.01)

(52) U.S. Cl. ..... 405/223.1; 405/224

(58) Field of Classification Search ..... 405/195.1, 405/196, 200, 223.1, 227, 224.2, 224.3, 224.4
See application file for complete search history.

(56) References Cited

U.S. PATENT DOCUMENTS

| | | | | | |
|---|---|---|---|---|---|
| H1246 | H | * | 11/1993 | Huffaker et al. | 405/223.1 |
| 5,443,330 | A | * | 8/1995 | Copple | 405/223.1 |
| 5,447,392 | A | * | 9/1995 | Marshall | 405/223.1 |
| 6,851,894 | B1 | | 2/2005 | Perret | |

* cited by examiner

*Primary Examiner*—Frederick L. Lagman
(74) *Attorney, Agent, or Firm*—Bracewell & Giuliani LLP

(57) ABSTRACT

A tension leg platform is secured to the sea floor with a plurality of tendons, each of the tendons being in tension due to buoyancy of the platform. The tendons are made up of joints of pipe secured together to define a hollow interior sealed from entry of sea water. A lower section of the joints of pipe of each of the tendons has smaller inner and outer diameters and greater wall thicknesses than an upper section of the joints of pipe. Bulkheads are sealed within the interior of the upper and lower sections of the joints of pipe of each of the tendons. The bulkheads are spaced apart from each other along the lengths of the upper and lower sections of the joints of pipe to define separate compartments sealed from each other.

17 Claims, 2 Drawing Sheets

STEPPED TENDON WITH SEALED BULKHEADS FOR OFFSHORE PLATFORM

This application claims the benefit of provisional application Ser. No. 60/561,831, filed Apr. 13, 2004.

FIELD OF THE INVENTION

This invention relates in general to offshore floating platforms, and in particular to a tension leg platform utilizing tendons with stepped outer diameters and internal sealed compartments.

BACKGROUND OF THE INVENTION

One technique for offshore drilling and production, particularly in deeper water, utilizes a tension leg platform ("TLP"). A TLP is secured by a number of tendons that attach to pilings in the sea floor. The TLP is de-ballasted to create a desired tension in each of the tendons. The tendons limit lateral movement of the TLP due to waves and currents.

Each of the tendons is preferably close to being neutrally buoyant so that it is substantially self supporting prior to connection to the TLP. Being approximately neutrally buoyant reduces the amount of buoyancy required by the TLP and thus the hull size. To provide buoyancy, the tendons have hollow interiors sealed from sea water. Typically, each tendon is made up of a plurality of joints of pipe, each being approximately 60 to 90 feet in length.

It is important to maintain the buoyancy, because if an interior of one of the tendons filled with sea water, the loss in buoyancy would result in excessive weight being applied to the TLP at the point of connection. It is known to mount sealed bulkheads in the joints of pipe to form separate sealed compartments in the interior of the tendon. Leakage of one compartment would not be as catastrophic as the entire interior of the tendon filling with sea water.

Each tendon must withstand the hydrostatic pressure of the surrounding sea water, which increases with depth. A greater wall thickness will increase the ability of a pipe to withstand hydrostatic pressure. However, a greater wall thickness throughout the length of the tendon would also increase the weight of the tendon, thus requiring a larger and more buoyant hull for the TLP. U.S. Pat. No. 6,851,894 discloses a stepped diameter tendon having upper, intermediate, and lower sections. The upper section has a greater diameter and thinner wall than the intermediate section. Similarly, the intermediate section has a greater diameter and thinner wall than the lower section. This patent does not disclose sealed bulkheads in the interiors of any of the sections.

SUMMARY OF THE INVENTION

In this invention, stepped diameter tendons are provided with bulkheads to define a plurality of sealed compartments in the interior. Each tendon has an elongated tubular portion. An upper section of the tubular portion has a larger diameter than a lower section of the tubular member. Both the inner and outer diameters are larger in the upper section. The lower section also has greater wall thickness. Preferably, the cross-sectional areas of the walls of the upper and lower sections are substantially the same.

The tubular portion has a hollow interior that is sealed for preventing entry of sea water. Sealed bulkheads are mounted in the interior of the tubular portion at selected intervals.

Preferably, the bulkheads are located both in the upper section and in the lower section of the tubular portion of each tendon. In the preferred embodiment, the tubular portion comprises a plurality of joints of pipe secured together. Each of the joints of pipe has at least one of the bulkheads and preferably two, one located at each end.

DETAILED DESCRIPTION OF THE INVENTION

Figure 1:
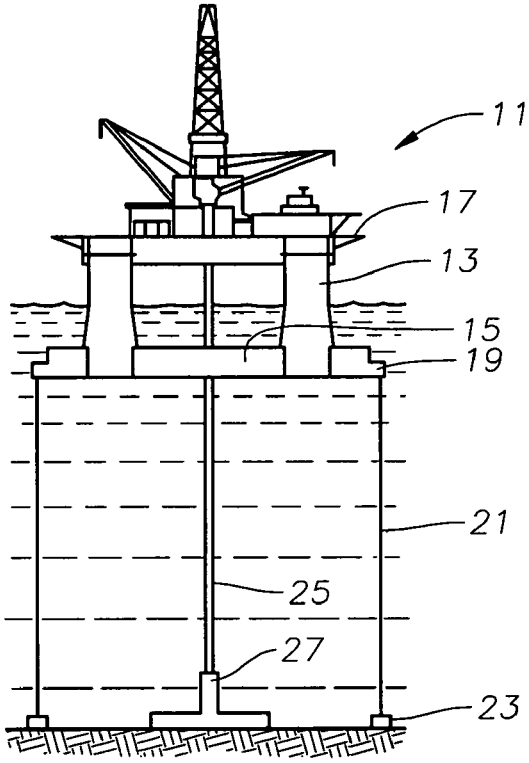
FIG. 1 is a schematic elevational view of a tension leg platform having tendons constructed in accordance with the invention.

Referring to FIG. 1, floating platform 11 may be of a variety of configurations and types. In this embodiment, platform 11 is a tension leg platform having a plurality of columns 13. In this embodiment, there are four vertical columns 13, one at each corner, but different numbers could be used, such as three columns. Horizontal sections 15 extend between columns 13 in this embodiment. Columns 13 and horizontal sections 15 are hollow to provide buoyancy, and are adapted to be selectively ballasted with seawater. Platform 11 has one or more decks 17 for supporting a variety of equipment for offshore drilling and production.

Upper tendon supports 19 are mounted to platform 11 at each corner. In this embodiment, each upper tendon support 19 is located on an end of one of the horizontal sections 15. Normally, two tendons 21 are supported at each tendon support 19, thus a platform 11 with four corners would have eight separate tendons 21. The lower end of each tendon 21 is secured to a piling 23. A riser 25 is shown extending from wellhead assembly 27 to platform deck 17. Riser 25 may be a drilling riser through which a drill string extends for drilling a well. Riser 25 could also be a production riser. In that instance, a Christmas tree (not shown) may be located at the upper end of riser 25 for controlling well fluid flowing upward from riser 25. If surface Christmas trees are employed, a number of production risers 25 will extend parallel to each other from the sea floor to platform 11, each riser 25 being connected to a separate wellhead. Alternately, subsea trees could be employed.

Figure 2:
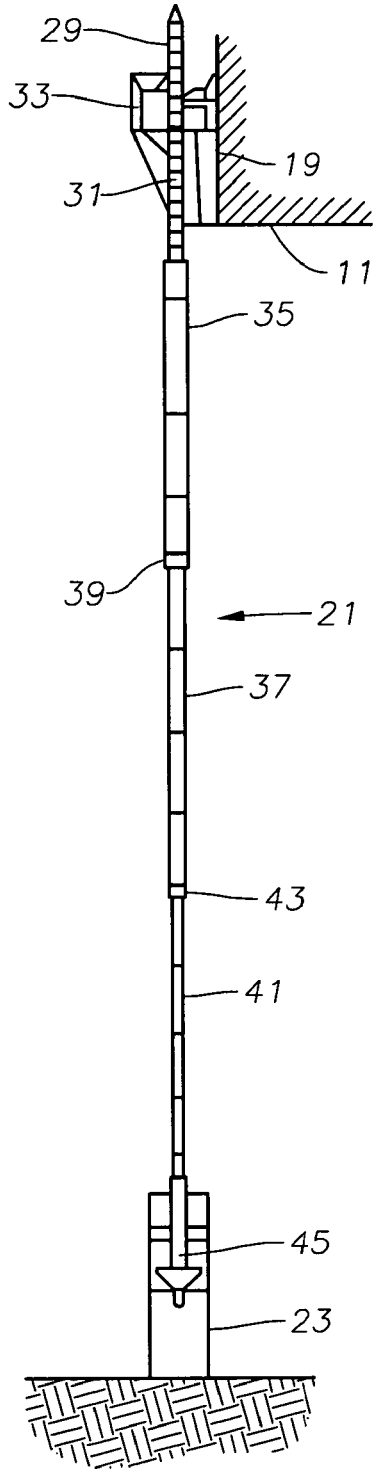
FIG. 2 is an enlarged elevational view of one of the tendons of FIG. 1.
Figure 3:
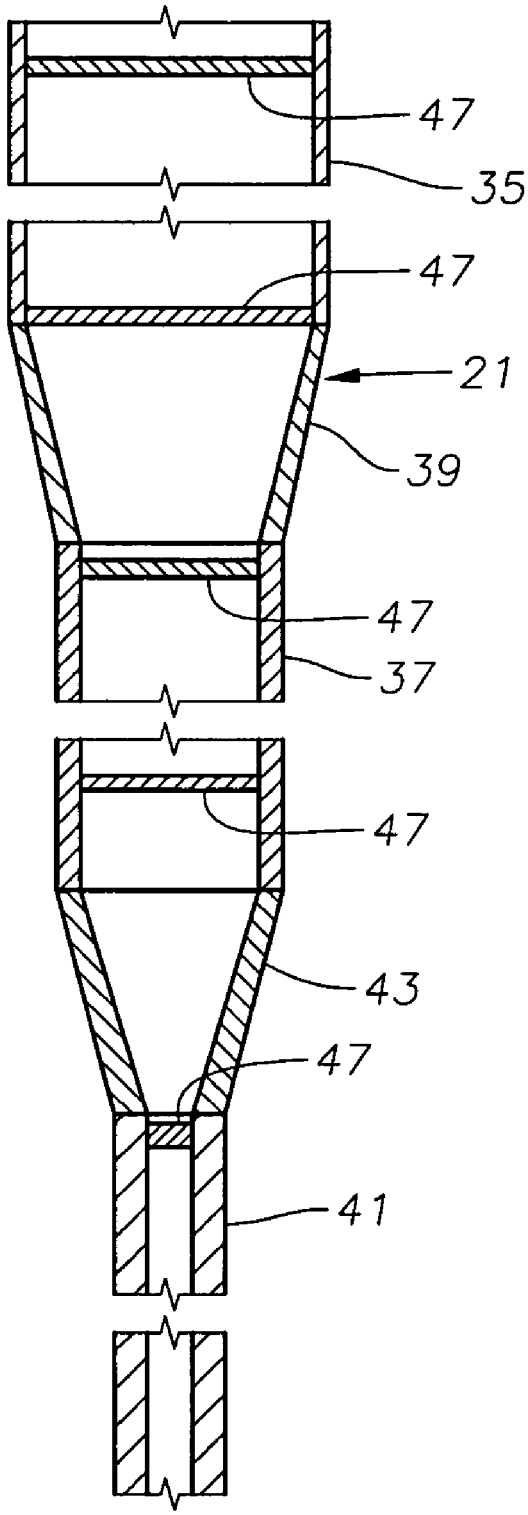
FIG. 3 is a further enlarged schematic sectional view of the tendon of FIG. 2.

Referring to FIG. 2, each tendon 21 has an upper termination 29. Upper termination 29 is typically a tubular member with circumferential grooves 31 on its exterior. A top connector 33 engages grooves 31 to hold tension in tendon 21. Top connector 33 could be of a variety of conventional designs. Each tendon 21 has an upper section 35 that is a steel tubular member, as shown in FIG. 3. In this embodiment, an adapter 39 connects tendon upper section 35 to a tendon intermediate section 37 that is of a smaller outer diameter. An adapter 39 connects intermediate section 37 to the lower end of upper section 35. Intermediate section 37 is shown connected to a lower section 41. Lower section 41 is even smaller in outer diameter than intermediate section 37. Adapter 43 connects intermediate section 37 to lower section 41. The three sections 35, 37 and 41 are shown by way of example and could number more or less than three. Each section 35, 37, 41 comprises a plurality of pipes secured together by fasteners or threads.

As shown in FIG. 3, the inner diameter of each section 35, 37 and 41 differs. Upper section 35 has a larger inner diameter than intermediate section 37. Intermediate section 37 has a larger inner diameter than lower section 41. In addition, the wall thickness of each section 35, 37, 41 preferably differs, with the thinnest being in upper section 35 and the thickest in lower section 41. The total cross-sectional area of each section 35, 37, 41, however, is preferably selected to be substantially the same so that the resistance to tensile strain is uniform throughout the length of tendon 21.

By having the smallest outer diameter section and thickest wall, tendon lower section 41 is better able to withstand the higher hydrostatic pressure of the sea water in which it is located. The larger diameter and thinner wall of the upper section 35 increases the buoyancy of tendon 21 by providing more volume for trapped air. The increased buoyancy in upper section 35 helps to support the weight of tendon 21, allowing for a reduced size of platform 11. Preferably, the diameters and wall thicknesses of upper, intermediate, and lower sections are selected to provide a slightly positive or neutral overall buoyancy for tendon 21, such as from 0.95 to 0.97. The slightly positive buoyancy avoids any part of tendon 21 going into compression prior to connection and tensioning with platform 11. Also, when tensioning, platform 11 does not have to initially lift the weight of tendons 21 if they are slightly positive in buoyancy.

A plurality of bulkheads 47 are mounted in each tendon 21 to reduce the consequences of accidental flooding of tendon 21. Bulkheads 47 separate the buoyancy volume into several sealed air compartments so that any leak along the length of tendon 21 will damage only one compartment. The compartment's lengths are selected so that if one or two flood, for example, the remaining compartments would provide sufficient buoyancy to support the weight of tendon 21. Preferably bulkheads 47 are located in each of the sections 35, 37 and 41.

The number of bulkheads 47 may vary. For example, bulkheads 47 could be located at the upper or lower ends of each pipe within upper section 35, intermediate section 37 and lower section 41. Each pipe is typically 60 to 90 feet in length. Alternately, bulkheads 47 could be spaced at greater intervals. Each bulkhead 47 may be secured within the inner diameter of one of the sections of tendon 21 by welding or in a variety of other manners.

Tendons 21 are installed and platform 11 deployed in a conventional manner. Tendons 21 are lowered into the sea and the lower ends latched into bottom connectors 45. Tendons 21 are self supporting, enabling platform 11 to be moved over tendons 21. Columns 13 and horizontal sections 15 are then ballasted until upper terminations 29 are attached to top connectors 33. Then columns 13 and horizontal sections 15 are de-ballasted, causing platform 11 to rise and apply the desired tension to tendons 21.

The invention has significant advantages. The sealed compartments within the stepped diameter tendons avoid catastrophic failure due to leakage. The larger volume of trapped air within the upper section provides additional buoyancy. The smaller diameter lower section better withstands hydrostatic pressure.

While the invention has been shown in only one of its forms, it should be apparent to those skilled in the art that it is not so limited, but is susceptible to various changes without departing from the scope of the invention.

We claim:

1. An apparatus for securing an offshore platform to a piling, comprising:

an elongated tubular member;

an upper section of the tubular member having a larger diameter than a lower section of the tubular member;

the tubular member having a hollow interior that is sealed for preventing entry of sea water; and a plurality of sealed bulkheads in the interior of the tubular member at selected intervals, defining a plurality of separate compartments that are sealed from each other.

2. The apparatus according to claim 1, wherein the bulkheads are located both in the upper section and in the lower section of the tubular member.

3. The apparatus according to claim 1, wherein:

the tubular member comprises a plurality of joints of pipe secured together; and each of the joints of pipe has at least one of the bulkheads.

4. The apparatus according to claim 1, wherein:

the tubular member comprises a plurality of joints of pipe secured together; and each of the joints of pipe has one of the bulkheads at an upper end and one of the bulkheads at a lower end.

5. The apparatus according to claim 1, wherein each of the bulkheads comprises a plate secured to an inner wall of the tubular member.

6. The apparatus according to claim 1, wherein each of the bulkheads comprises a circular plate welded to an inner wall of the tubular member.

7. The apparatus according to claim 1, wherein the upper and lower sections of the tubular member have substantially the same cross-sectional areas measured between inner and outer diameters.

8. An apparatus for securing an offshore platform to a piling, comprising:

a tendon having an upper termination for securing to an offshore platform and a lower termination for securing to a piling on a sea floor;

the tendon comprising a plurality of joints of pipe secured together to define a hollow interior sealed from entry of sea water;

a lower section of the joints of pipe having smaller inner and outer diameters and greater wall thicknesses than an upper section of the joints of pipe; and a plurality of sealed bulkheads spaced apart from each other along the lengths of the upper and lower sections, defining a plurality of separate compartments in the interior that are sealed from each other.

9. The apparatus according to claim 8, wherein each of the joints of pipe has at least one of the bulkheads.

10. The apparatus according to claim 8, wherein:

each of the joints of pipe has one of the bulkheads at an upper end and one of the bulkheads at a lower end.

11. The apparatus according to claim 8, wherein each of the bulkheads comprises a plate secured to an inner wall of the one of the joints of pipe.

12. The apparatus according to claim 8, wherein each of the bulkheads comprises a circular plate welded to an inner wall of the one of the joints of pipe.

13. The apparatus according to claim 8, wherein each of the joints of pipe in the upper section and in the lower section has a wall with a cross-sectional area that is substantially the same.

14. An apparatus for performing offshore hydrocarbon extraction operations, comprising:

a floating tension leg platform;

a plurality of tendons, each of the tendons having an upper termination secured to the offshore platform and a lower termination secured to a piling on a sea floor, the platform being ballasted to create tension in the tendons;

each of the tendons comprising a plurality of joints of pipe secured together to define a hollow interior sealed from entry of sea water;

a lower section of the joints of pipe of each of the tendons having smaller inner and outer diameters and greater wall thicknesses than an upper section of the joints of pipe; and a plurality of bulkheads sealed within the interior of the upper and lower sections of the joints of pipe of each of the tendons, each of the bulkheads being spaced apart from each other along the lengths of the upper and lower sections of the joints of pipe to define separate compartments sealed from each other.

15. The apparatus according to claim 14, wherein each of the joints of pipe has at least one of the bulkheads.

16. The apparatus according to claim 14, wherein: each of the joints of pipe has one of the bulkheads at an upper end and one of the bulkheads at a lower end.

17. The tendon according to claim 14, wherein each of the bulkheads comprises a flat circular plate.

* * * * *

UNITED STATES PATENT AND TRADEMARK OFFICE

CERTIFICATE OF CORRECTION

PATENT NO. : 7,163,356 B2
APPLICATION NO. : 11/104826
DATED : January 16, 2007
INVENTOR(S) : Edward Huang et al.

It is certified that error appears in the above-identified patent and that said Letters Patent is hereby corrected as shown below:

In the Claims:

Column 6, line 10, delete "tendon" and substitute --apparatus --

Signed and Sealed this

First Day of May, 2007

JON W. DUDAS
*Director of the United States Patent and Trademark Office*